US011584575B2

(12) United States Patent
Siitonen

(10) Patent No.: US 11,584,575 B2
(45) Date of Patent: Feb. 21, 2023

(54) MOISTURE CONTROL MATERIAL

(71) Applicant: Stora Enso OYJ, Helsinki (FI)

(72) Inventor: Simo Siitonen, Rautjärvi (FI)

(73) Assignee: Stora Enso OYJ, Helsinki (FI)

( * ) Notice: Subject to any disclaimer, the term of this patent is extended or adjusted under 35 U.S.C. 154(b) by 578 days.

(21) Appl. No.: 16/611,568

(22) PCT Filed: May 7, 2018

(86) PCT No.: PCT/IB2018/053147
§ 371 (c)(1),
(2) Date: Nov. 7, 2019

(87) PCT Pub. No.: WO2018/207072
PCT Pub. Date: Nov. 15, 2018

(65) Prior Publication Data

US 2020/0095039 A1 Mar. 26, 2020

(30) Foreign Application Priority Data

May 8, 2017 (SE) ..... 1750560-3

(51) Int. Cl.
*B65D 65/42* (2006.01)
*D21H 21/22* (2006.01)
(Continued)

(52) U.S. Cl.
CPC ..... *B65D 65/42* (2013.01); *D21H 17/66* (2013.01); *D21H 19/76* (2013.01); *D21H 21/22* (2013.01); *D21H 27/10* (2013.01); *D21H 19/10* (2013.01)

(58) Field of Classification Search
None
See application file for complete search history.

(56) References Cited

U.S. PATENT DOCUMENTS 2,807,514 A 3/1955 Williams
4,997,082 A 3/1991 Durocher
(Continued)

FOREIGN PATENT DOCUMENTS

CN 101151412 A 3/2008
CN 101166779 A 4/2008
(Continued)

OTHER PUBLICATIONS

International Searching Authority, Written Opinion of the International Searching Authority, PCT/IB2018/053147, dated Nov. 15, 2018.

(Continued)

*Primary Examiner* — Dennis R Cordray
(74) *Attorney, Agent, or Firm* — Greer, Burns & Crain, Ltd.

(57) ABSTRACT

Method of manufacturing an active moisture control material, wherein the material is formed from a base board comprising cellulose fibers and having a basis weight in the range of from 50 to 500 g/m2 and having a bulk of at least 1.2 cm3/g, wherein the method comprises a surface treatment of at least one side of said base board with a surface treatment composition comprising carboxymethyl cellulose (CMC) and a metal salt, wherein said surface treatment composition comprises carboxymethyl cellulose in a range of from 2 to 10 weight-% based on the total solid content of said surface treatment composition, and the metal salt in a range of from 10 to 30 weight-% based on the total solid content of said composition.

15 Claims, 1 Drawing Sheet

(51) Int. Cl.

| | |
|---|---|
| ***D21H 27/10*** | (2006.01) |
| ***D21H 17/66*** | (2006.01) |
| ***D21H 19/76*** | (2006.01) |
| *D21H 19/10* | (2006.01) |

(56) References Cited

U.S. PATENT DOCUMENTS

| | | | |
|---|---|---|---|
| 5,936,178 | A | 8/1999 | Saari |
| 10,022,944 | B2 | 7/2018 | Schuman et al. |
| 10,751,696 | B2 | 8/2020 | Crapanzano et al. |
| 2008/0153371 | A1 | 6/2008 | Losch et al. |
| 2009/0311510 | A1 | 12/2009 | Ogawa et al. |
| 2012/0301641 | A1 | 11/2012 | Zhou et al. |
| 2013/0292279 | A1 | 11/2013 | Bengtsson et al. |
| 2016/0001264 | A1 | 1/2016 | Crapanzano et al. |
| 2017/0087810 | A1 | 3/2017 | Schuman et al. |
| 2017/0120556 | A1* | 5/2017 | Nyman ..... B32B 15/20 |

FOREIGN PATENT DOCUMENTS

| | | | |
|---|---|---|---|
| CN | 102284988 | A | 12/2011 |
| CN | 103154371 | A | 6/2013 |
| CN | 105163845 | A | 12/2015 |
| CN | 105951520 | | 9/2016 |
| CN | 106103093 | A | 11/2016 |
| GB | 1369992 | | 10/1974 |
| JP | 2002004193 | A | 1/2002 |
| JP | 2015013647 | | 1/2015 |
| RU | 2407686 | C1 | 12/2010 |
| WO | 2009106493 | | 9/2009 |
| WO | 2015136493 | | 9/2015 |
| WO | 2015140097 | | 9/2015 |

OTHER PUBLICATIONS

International Searching Authority, International Search Report, PCT/IB2018/053147, dated Nov. 15, 2018.

* cited by examiner

MOISTURE CONTROL MATERIAL

This application is a U.S. National Phase under 35 U.S.C. § 371 of International Application No. PCT/IB2018/053147, filed May 7, 2018, which claims priority under 35 U.S.C. §§ 119 and 365 to Swedish Application No. 1750560-3, filed May 8, 2017.

TECHNICAL FIELD

The present invention relates to a method of manufacturing a packaging material with improved barrier properties, and to a material produced by said method. More particularly, the present disclosure relates to a method of manufacturing an active moisture control material for a packaging where the moisture level inside the packaging (e.g. cigarette or dry food packaging) may be stabilized so that the product inside will be stored at constant humidity before and after opening the package

BACKGROUND

In many types of packaging the material must have barrier properties for moisture, aroma, oxygen etc. which is needed to preserve the quality of the product which is contained in the packaging. About 100 million tons of food is wasted annually. This is equivalent to ⅓ of all food produced in the world. Food is wasted throughout the whole food chain. Improved packaging is not a solution to all food waste, but 20-25% of food waste in the households is related to packaging. Usually this barrier may be a so called a passive barrier, where there are separate barrier layers in the structure. In e.g. a cigarette package there is usually a plastic film wrapping combined with an aluminum foil or aluminum laminate structures.

After the opening of the package, it is a further challenge to keep the original moisture level or keep it as close to the original as possible, inside the packaging. This is very critical for moisture sensitive products like cigarettes.

Various solutions to be able to provide a more active moisture control have been suggested in the art. In for instance, U.S. Pat. No. 4,997,082A discloses a humidistat pad which is included in the packaging. Other solutions are presented in e.g. US2013292279A where a cigarette package is disclosed in which a layer of a fibrous material having a moisture barrier layer is embedded within the layer of the fibrous material or coated on the outside of the fibrous layer. The barrier layer comprises a polymer layer, which has limited capacity for absorbing moisture. In WO09106493A1 a packaging with humidity control is disclosed. This packaging has a laminate structure, and a moisture-containing layer is interposed between two polymeric layers. The moisture-containing layer may be a paper saturated with water or aqueous salt solution, which can give control over the evaporation. The polymeric layers may be provided with tear-off strips to expose the moisture-containing layer inside the container, in order to hydrate the tobacco inside.

A fiber based active packaging material is also attractive from an environmental point of view. Packaging made from active fiber based materials may for instance prevent oxygen to deteriorate food or stop bacteria growth in food substances.

There is a need for an improved manufacturing method for packaging and improved packaging materials, which materials can actively control the humidity inside of the package, and which is further more easily manufactured or which does not require several layers or laminate structures.

SUMMARY

It is an object of the present disclosure, to provide a method of manufacturing an improved material for active moisture control, which eliminates or alleviates at least some of the disadvantages of the prior art materials.

More specific objects include providing a packaging formed from the moisture control material and methods for manufacturing the moisture control material.

The invention is defined by the appended independent claims. Embodiments are set forth in the appended dependent claims and in the following description and drawings.

According to a first aspect there is provided a method of manufacturing an active moisture control material, wherein the material is formed from a base board comprising cellulose fibers and having a basis weight in the range of from 50 to 500 g/m$^2$ and having a bulk of at least 1.2 cm$^3$/g, wherein the method of the first aspect comprises a surface treatment of at least one side of said base board with a surface treatment composition comprising carboxymethyl cellulose (CMC) and a metal salt, wherein said surface treatment composition comprises carboxymethyl cellulose in a range of from 2 to 10 weight-% based on the total solid content of said surface treatment composition, and the metal salt in a range of from 10 to 30 weight-% based on the total solid content of said composition.

By active moisture control material is meant an active material which can absorb moisture, such as water, from the environment, or prevent moisture for instance escaping a closed compartment, or even provide moisture, i.e. desorption of moisture, to the environment or the compartment it encloses or is adjacent to. This material is thus not a so called passive barrier material.

By providing at least one side of the base board with the surface treatment composition comprising CMC and a metal salt, it has surprisingly been shown that a material having good moisture controlling properties in a wide range of humidity levels, as well an even distribution of the composition onto the base board is provided. The layer thickness may be measured after coating in different places. By good moisture controlling properties is meant that the base board is able to absorb enough moisture in a preconditioning or pre-moisturizing step, and keep this moisture level inside the material, even if subjected to dry conditions, such as for instance opening a package. The moisture control properties may be defined or characterized by absorption velocity and desorption velocity measurements in different types of temperature and moisture conditions. The material further shows improved strength as compared with conventional treatments comprising only CMC, or only salt.

The porosity of the board enables the surface treatment composition to be incorporated into the base board in a sufficient amount.

The inventive combination of CMC and a metal salt thus provides both good moisture capacity and desorption properties.

This material may thus form a base packaging material in itself, in contrast to having a separate moisture control or humidifier material in a packaging, such as for instance a cigarette box. This means that it may be easier to manufacture for instance a cigarette box, and also, after it has been opened it may be possible to have an improved control over the humidity inside the packaging. This means that the material may be produced in any conventional paper or board making process.

The surface treatment may comprise applying said composition directly onto said at least one side of said base board.

The surface treatment may be any one of a surface sizing and a coating operation.

This means that the surface treatment may easily be incorporated into a conventional papermaking process.

The bulk of the base board may be more than 1.5 $cm^3/g$, or preferably more than 2.0 $cm^3/g$.

This means that the base board preferably is a high-bulk material, which can readily absorb the surface treatment composition.

According to one alterative of the first aspect the surface treatment composition may comprise the metal salt in a range of from 10 to 20 weight-% based on the total solid content of the composition.

The surface treatment composition may further be an aqueous suspension, having a dry content in the range of from 2 to 40%, or preferably in the range of from 10 to 30%.

The surface treatment composition may be applied onto the at least one side of said base board in an amount in a range of from 10 to 150 $g/m^2$, and preferably in the range of from 30 to 100 $g/m^2$.

The metal salt may be selected from the group consisting of any one of a sodium chloride, calcium chloride, potassium chloride and sodium nitrate.

The preferred metal salt is sodium nitrate, due to its capacity for absorbing moisture, especially at a desired humidity of around 65% RH.

The base board may be any one of a paper and a paperboard. The base board may thus be any type of paper or paperboard conventionally used in for instance packaging applications, i.e. not a chipboard. The basis weight of the base board may preferably be in the range of 110 to 500 $g/m^2$.

The material may be dried subsequent to the application of the surface treatment composition. The drying may be any conventional drying process.

The material may be pre-conditioned subsequent to the application of the surface composition. The pre-conditioning may be a pre-moisturizing step. The pre-conditioning may take place after the drying step.

According to a second aspect there is provided an active moisture control material, obtained through the method according to the first aspect, wherein the material is formed from a base board comprising cellulose fibers and having a basis weight in the range of from 175 to 500 $g/m^2$, or preferably in the range of 250 to 500 $g/m^2$ and a bulk of more than 1.2 $cm^3/g$.

By having applied the inventive surface treatment comprising CMC and a metal salt, the material is provided with good moisture controlling properties in a wide range of humidity levels.

The said surface treatment composition may be provided onto an inner side of said material, and wherein the material is provided with further barrier layers on an opposite side thereof, wherein said further barrier layers comprises any one of a wax, a synthetic polymer and a biobased polymer.

According to a third aspect there is provided a blank for packaging applications formed from the material according to the second aspect.

According to a fourth aspect there is provided a packaging formed from the active moisture control material according to the second aspect, or from the blank according to the third aspect, forming an active moisture control packaging.

By active moisture control packaging is meant a packaging or a packaging material which is adapted for holding moisture sensitive materials therein. These types of packaging or packaging materials are used in for instance cigarette packages, or for various types of food.

This means that for instance a cigarette package or box can be formed by using the active moisture control material as a base packaging or and a blank for the entire package, and the active moisture control material is thus enclosing the cigarettes, i.e. the fiber material can be directly against the packed product. The active control material thus forms the main structure of the package. Conventionally cigarette boxes comprise several separate layers to keep the moisture inside the package. With the active moisture control material the moisture may already be in the material, thus providing the required humidity for the packaged product, while still providing for an easy way of manufacturing the package. The moisture control can thus be a fast process as there is no other barrier layer arranged on the inside of the packaging.

By using the active moisture control material to form the packaging there is not only provided a way of improving the control of the moisture inside the package, not only during storage and transpiration, but also when the package has been opened, but also a way of producing a moisture control packaging in an easy manner. The moisture level inside packaging can thus be stabilized (e.g. the cigarette or dry food packaging) so that product inside will be stored at constant humidity before, and after, opening the package.

By the term "pre-conditioning" it is meant stabilizing right moisture content to the packaging material and also stabilizing right moisture content to the inside volume of the package. This means that once the material has been pre-conditioned, no other humidifying measures need to be taken to ensure the correct environment for the packaged product. The pre-conditioning may take place just before closing the package, but may also be made in connection with the production of the moisture control material or a blank for forming the packaging.

The packaging may further be provided with, or comprise, a passive barrier layer.

The packaging may even further be provided with, or comprise, an outer paper or board layer.

The packaging thus forms a laminate structure, which may comprise the following structure board/passive barrier/moisture control material, or alternatively board/moisture control material, where the active control material is placed in connection with the inside of the packaging and the board or paper layer is on the outside, to provide improved structural stiffness to the packaging.

The packaging may essentially be used for all types of moisture sensitive products, such as food, cigarettes, medicaments, cosmetics, electronics, metal products, apparel and shoes. The packaging could for instance be used for packaging clothes (apparel) or shoes to avoid using or decreasing use of anti-mold additives.

BRIEF DESCRIPTION OF THE DRAWINGS

The present solution will now be described, by way of example, with reference to the accompanying drawings.

DESCRIPTION OF EMBODIMENTS

Figure 1:
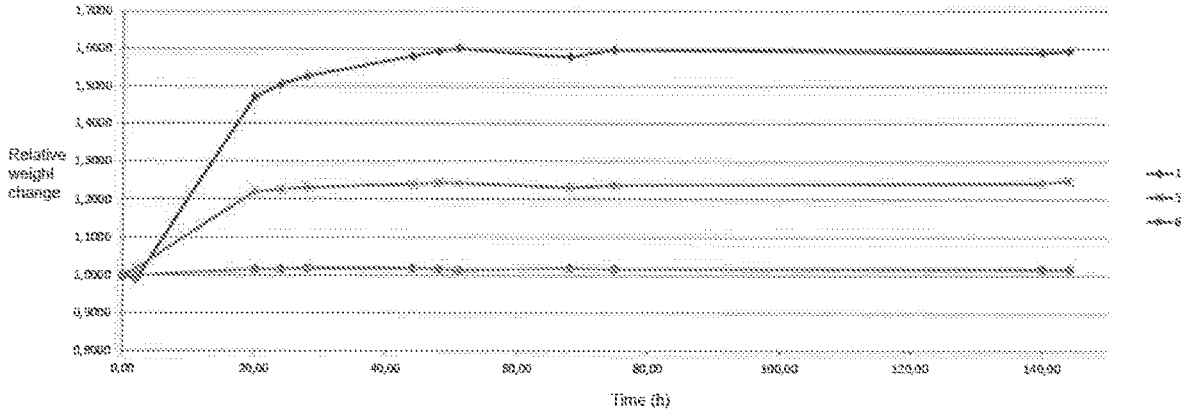
FIG. 1 illustrates a graph showing absorption capacity.

The invention relates to a manufacturing method of an active moisture control material, where a base board is provided with a surface treatment composition, i.e. the surface treatment composition is applied to the base board. In the inventive method at least one side of the base board is provided with the surface treatment composition.

The surface treatment composition may be applied directly onto the base board, for instance in a conventional paper making process. The surface treatment composition may be applied in a surface sizing step, such as a surface press or alternatively as a coating, such as through dispersion coating, blade coating, curtain coating, rod coating, slot-die coating and spray technologies or printing technologies.

Subsequent to the application of the surface treatment composition the material may be dried. The drying process may be any conventional drying method, such as using hot cylinders, air drying or vacuum drying.

The dry content of the material after drying is preferable in the range of 1 to 13%, and most preferably in the range of 2 to 10%.

The base board may be any one of a paper or paper board. The base board may essentially be any type of web type material, where fiber material is produced from non-fossile based raw materials, and which is used in conventional paper or board making processes. The base board may further be made from any type of a cellulose based material.

The base board has a grammage or basis weight in the range of from 50 to 500 g/m$^2$, preferably in the range of 110 to 500 g/m$^2$, or even in the range of 175 to 500 g/m$^2$.

The porosity of the base board may be defined as bulk, which is measured according to standard ISO 534.

The bulk of the base board is preferably more than 1.2 cm$^3$/g, or preferably above 1.5 cm$^3$/g, or even more preferred above 2.0 cm$^3$/g. The paper or paperboard is therefore preferably a so called high-bulk material. The bulk correlates to the porosity of the base board, and thus also the ability of the base board to absorb the surface treatment composition in or into the base board. By applying the surface treatment onto the base board there is therefore formed an active moisture control material. The EU Commission Regulation (EC) No 450/2009 on active and intelligent materials and articles intended to come into contact with food, defines that these active material include absorbing/scavenging systems, releasing systems and systems with substances grafted or immobilized on wall of the packaging.

The surface treatment composition comprises carboxymethyl cellulose (CMC) and a metal salt.

The proportion or amount of CMC in the composition is preferably in the range of 2 to 10 weight-% based on total solid content of said composition.

The composition comprises metal salt in an amount of around 10-30 weight-%, or most preferably around 10-20 weight-% based on total solid content of said composition.

The surface treatment composition may be an aqueous composition with a dry content in the range of from 2 to 40%, and preferably in the range of from 10 to 30%.

The composition is preferably applied onto the surface of the base board in an amount of from 10 to 150 g/m$^2$, and preferably in the range of from 30 to 100 g/m$^2$.

The metal salt is preferably chosen from the group of sodium chloride, calcium chloride and potassium chloride, sodium nitrite.

In one embodiment the metal salt is sodium nitrite, due to its capacity for absorbance, especially at desired humidity area of around relative humidity (RH) 65%.

The moisture control properties of the material may be measured and defined as an absorption capacity or velocity of the material from 22° C. and 60% relative humidity to 30° C. and 65% relative humidity, and a desorption velocity or capacity from 22° C. and 60% relative humidity to 35° C. and 15% relative humidity.

It has been shown that the application of CMC and metal salt in these amounts provide good coverage and quality of the end product and yet applicable from a process engineering point of view.

The active control material may be used as a blank or base packaging material to for different types of packages.

The packaging formed from the active moisture control material or the active moisture control material itself, may be pre-conditioned prior to the closing of the package. By pre-conditioning is meant that the material may be for instance pre-moisturized, i.e. made to absorb moisture, such as water, or water mixed with additives, such as PEG.

The moisture content after pre-conditioning or pre-moisturizing may be in the range of 2 to 30%. The moisture content after pre-moisturizing varies depending on the desired relative humidity in for instance the packaging formed from the material.

This pre-conditioning may take place during converting the blank into the packaging material or during filling of the packaging.

The pre-conditioning may be preceded by a drying operation, as described above.

The packaging comprising the active control material may be used for all types of moisture sensitive products, such as cigarettes, medicaments, cosmetics, electronics, metal products, apparel, shoes and food.

In one alternative embodiment the base board may be provided with the surface treatment composition in a moisture control pattern at well-defined areas of the base board, such that it is only this area or pattern that has the active moisture control properties. This may be done by printing process or slot die coating etc.

According to one alternative embodiment a passive barrier material may be provided onto the active moisture control material. Such a passive barrier material may be any one of a synthetic or renewable polymer. Examples of synthetic polymers may be any one of low density polyethylene (LDPE), high density polyethylene (HDPE), polypropylene (PP) and polyethylene terephthalate (PET). Examples of renewable polymeras may be so called green polyethylene (PE), green polyethylene terephthalate (PET), polylactic acid and polybutylene succinate (PBS). The passive barrier material may be applied onto the active control material during the manufacturing, for instance as a coating or film layer, or afterwards as a detachable film.

Examples of film application are film lamination, glue lamination, pressure sensitive lamination. The barrier layer may alternatively be applied through dispersion, water or solvent based coating systems. It may also be extrusion coated or extrusion laminated onto the active moisture control material.

In addition to providing the active moisture control material with a passive barrier, it may also be provided with a paper or board layer in a laminate structure, i.e. board/passive barrier/moisture control material. The active moisture control material would be inside the package. This would provide the advantage that stiffness to the package is generated mainly from outer board/paper layer which would not be absorbing moisture to any greater extent.

In view of the above detailed description of the present invention, other modifications and variations will become apparent to those skilled in the art.

However, it should be apparent that such other modifications and variations may be effected without departing from the spirit and scope of the invention.

Absorption and Desorption Tests

A base board comprising was surface sized using three different surface treatment compositions.

Sample no 1 was treated with a surface treatment composition comprising 10% based on total solid content of said composition CMC+30% based on total solid content of said composition $NaNO_2$, in accordance with the invention, and compared to a base board treated with a coating with almost 100% salt based on total solid content of said composition salt and using Boveda: sodium formate+sodium lactate (Sample no. 5) and a base board treated with only CMC (Sample no. 6).

Figure 2:
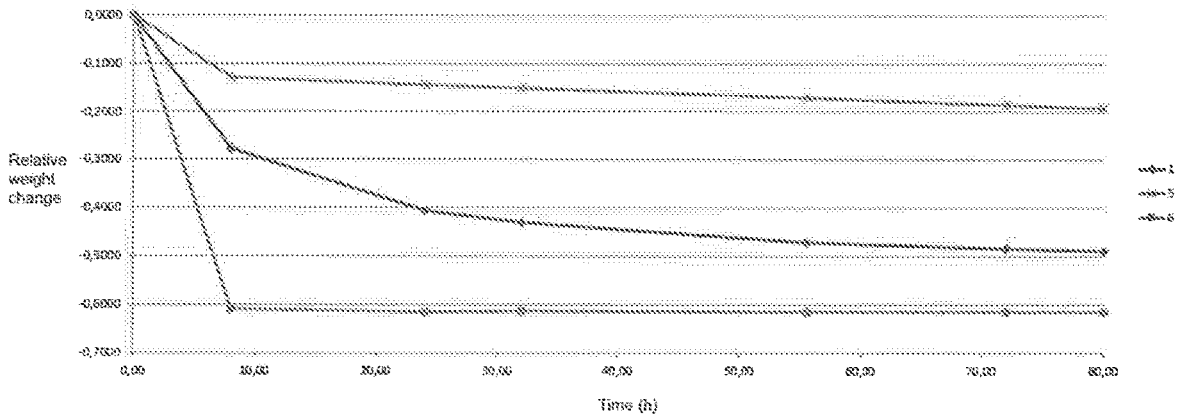
FIG. 2 illustrates a graph showing desorption capacity.

As can be seen in FIG. 1 the inventive surface sizing (No. 1) has the best absorption capacity (at an increase from RH 60 to RH 70) and in FIG. 2, yet an acceptable desorption capacity (at a decrease from RH 60 to RH 15).

The invention claimed is:

1. Method of manufacturing an active moisture control material, wherein the material is formed from a base board comprising cellulose fibers and having a basis weight in the range of from 50 to 500 g/m$^2$ and having a bulk of at least 1.2 cm$^3$/g, wherein said method comprises a surface treatment of at least one side of said base board with a surface treatment composition comprising carboxymethyl cellulose (CMC) and a metal salt, wherein said surface treatment composition comprises carboxymethyl cellulose in a range of from 2 to 10 weight-% based on the total solid content of said surface treatment composition, and the metal salt in a range of from 10 to 30 weight-% based on the total solid content of said composition; and wherein said surface treatment composition is applied onto the at least one side of said base board in an amount in a range of from 10 to 150 g/m$^2$.

2. The method as claimed in claim 1, wherein said surface treatment comprises applying said composition directly onto said at least one side of said base board.

3. The method of claim 1, wherein said surface treatment is any one of a surface sizing and a coating operation.

4. The method of claim 1, wherein the bulk is more than 1.5 cm$^3$/g.

5. The method of claim 1, wherein the surface treatment composition comprises the metal salt in a range of from 10 to 20 weight-% based on the total solid content of the composition.

6. The method of claim 1, wherein said surface treatment composition is an aqueous suspension, having a dry content in the range of from 2 to 40%.

7. The method claim 1, wherein said metal salt is selected from the group consisting of any one of a sodium chloride, calcium chloride, potassium chloride and sodium nitrate.

8. The method of claim 1, wherein said base board is any one of a paper and a paperboard.

9. The method of claim 1, wherein the basis weight of the base board is in the range of 110 to 500 g/m$^2$.

10. The method of claim 1, wherein the material is dried subsequent to the application of the surface treatment composition.

11. The method of claim 1, wherein the material is pre-conditioned subsequent to the application of the surface composition.

12. The method of claim 1, wherein the bulk is more than 2.0 cm$^3$/g.

13. The method of claim 1, wherein said surface treatment composition is an aqueous suspension having a dry content in the range of from 10 to 30%.

14. The method of claim 1, wherein said surface treatment composition is applied onto the at least one side of said base board in an amount in the range of from 30 to 100 g/m$^2$.

15. Method of manufacturing an active moisture control material, wherein the material is formed from a base board comprising cellulose fibers and having a basis weight in the range of from 50 to 500 g/m$^2$ and having a bulk of at least 1.2 cm$^3$/g, wherein said method comprises a surface treatment of at least one side of said base board with a surface treatment composition comprising carboxymethyl cellulose (CMC) and a metal salt, wherein said surface treatment composition comprises carboxymethyl cellulose in a range of from 2 to 10 weight-% based on the total solid content of said surface treatment composition, and the metal salt in a range of from 10 to 30 weight-% based on the total solid content of said composition; and wherein the material is pre-conditioned subsequent to the application of the surface composition.

* * * * *